US010703603B2

(12) United States Patent
Zheng et al.

(10) Patent No.: US 10,703,603 B2
(45) Date of Patent: Jul. 7, 2020

(54) OPERATING A CYCLICAL TRANSPORT SYSTEM BASED ON AN EQUAL CYCLE TIME

(71) Applicant: ThyssenKrupp Elevator AG, Essen (DE)

(72) Inventors: Qinghua Zheng, Munich (DE); Florian Dignath, Munich (DE); Erhard Lampersberger, Munich (DE); Thomas Beck, Dorfen (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 418 days.

(21) Appl. No.: 15/518,986

(22) PCT Filed: Oct. 9, 2015

(86) PCT No.: PCT/EP2015/073409
§ 371 (c)(1),
(2) Date: Apr. 13, 2017

(87) PCT Pub. No.: WO2016/058940
PCT Pub. Date: Apr. 21, 2016

(65) Prior Publication Data

US 2017/0233218 A1 Aug. 17, 2017

(30) Foreign Application Priority Data

Oct. 16, 2014 (DE) ..... 10 2014 220 966

(51) Int. Cl.
*B66B 1/24* (2006.01)

(52) U.S. Cl.
CPC ..... *B66B 1/2491* (2013.01); *B66B 1/2466* (2013.01); *B66B 2201/243* (2013.01); *B66B 2201/401* (2013.01)

(58) Field of Classification Search
USPC ..... 187/247
See application file for complete search history.

(56) References Cited

U.S. PATENT DOCUMENTS 5,107,962 A 4/1992 Ekholm
6,520,295 B1 * 2/2003 Sansevero ..... B66B 9/00 187/251

(Continued)

FOREIGN PATENT DOCUMENTS

CN 1721311 A 1/2006
CN 203158978 U 8/2013

(Continued)

OTHER PUBLICATIONS

English translation of International Search Report issued in PCT/EP2015/073409 dated Dec. 8, 2015 (mailed Dec. 15, 2015).

(Continued)

*Primary Examiner* — Christopher Uhlir
(74) *Attorney, Agent, or Firm* — thyssenkrupp North America, LLC

(57) ABSTRACT

A transport system may include at least two conveyor sections and at least three cars that are moved individually in a cyclical operation. Each car may pass through a first conveyor section starting from a first start position and subsequently pass through a second conveyor section back to the first start position. At least one stopping point may be provided at least along a conveyor section, and one or more subsequent stopping points may respectively be assigned to a block. Travel of the cars may be controlled such that the cars successively approach a respective previously-specified block, and an equal cycle time is predefined for every car to pass through the first and second conveyor sections. A method for operating a transport system in this manner is also disclosed.

19 Claims, 2 Drawing Sheets

(56) References Cited

U.S. PATENT DOCUMENTS

| | | | | |
|---|---|---|---|---|
| 6,955,245 | B2 | 10/2005 | Dunser | |
| 10,196,233 | B2 * | 2/2019 | Witczak | B66B 1/2466 |
| 2003/0098208 | A1 | 5/2003 | Hikita | |
| 2004/0173417 | A1 | 9/2004 | Jokela | |
| 2010/0078266 | A1 | 4/2010 | Choi | |
| 2012/0152661 | A1 * | 6/2012 | Suzuki | B66B 1/2458 187/382 |
| 2015/0090534 | A1 | 4/2015 | Finschi | |

FOREIGN PATENT DOCUMENTS

| | | | |
|---|---|---|---|
| CN | 103303769 | A | 9/2013 |
| CN | 103303770 | A | 9/2013 |
| DE | 3732240 | C | 10/1997 |
| EP | 0769469 | A | 4/1997 |
| EP | 1647513 | A | 4/2006 |
| EP | 1440030 | B | 8/2006 |
| EP | 2307300 | B | 4/2011 |
| EP | 2341027 | B | 7/2011 |
| JP | H05-039173 | A | 2/1993 |
| JP | H05-097353 | A | 4/1993 |
| JP | H06-271214 | A | 9/1994 |
| KR | 10-2011-0103977 | A | 9/2011 |
| WO | 2004048243 | A | 6/2004 |
| WO | 2004048244 | A | 6/2004 |
| WO | 2007024488 | A | 3/2007 |
| WO | 2008136692 | A | 11/2008 |
| WO | 2009072138 | A | 6/2009 |
| WO | 2011140887 | A | 11/2011 |

OTHER PUBLICATIONS

English abstract of JPH06271214.
English machine translation of DE372240.
English abstract of EP2341027.

* cited by examiner

OPERATING A CYCLICAL TRANSPORT SYSTEM BASED ON AN EQUAL CYCLE TIME

CROSS REFERENCE TO RELATED APPLICATIONS

This application is a U.S. National Stage Entry of International Patent Application Serial Number PCT/EP2015/073409, filed Oct. 9, 2015, which claims priority to German Patent Application No. DE 10 2014 220 966.8 filed Oct. 16, 2014, the entire contents of both of which are incorporated herein by reference.

FIELD

The present disclosure generally relates to methods for operating transport systems, such as elevator systems, and to corresponding transport systems or elevator systems.

BACKGROUND

For conventional elevator systems there are various control methods which perform favorable distribution of the travel orders among the available elevator cars. For this purpose, the travel requests by the passengers when they press a request key are collected and administered by a control unit. In simple systems, it is merely decided which car will be the next to serve the corresponding story, and in advanced systems with what is referred to as "destination selection control", the travel orders are bundled at the known start position of the passenger and the desired destination position. The passengers must in this case input their travel destination on an operator keypad before they enter the car. Furthermore, the control methods usually take into account different peripheral conditions such as e.g. the expected overall travel time for a passenger or the maximum waiting time of a passenger.

Elevator shafts are frequently already organized into groups when planning buildings, wherein certain groups serve predetermined areas of stories respectively. In buildings with a particularly large passenger volume, express elevators are also provided which serve individual stories. The passengers must then, under certain circumstances, change elevators in order to reach their destination. Such groupings of elevator shafts serve to dissipate traffic flows, but result in large expenditure in terms of construction technology and require a large amount of space.

The conventional elevator systems can be differentiated according to the number of elevator cars per shaft. Most conventional elevator systems have in common the fact that in each case just one car is located in a shaft. Therefore, there are no peripheral conditions or restrictions whatsoever in respect of the travel orders of the cars in relation to one another.

In so-called multicar elevator systems, two or more cars move in one shaft. An example of this is the "TWIN" elevator system by the applicant in which case two cars are located in one shaft respectively and can move independently of one another. The control method of this system is based on the destination selection control already mentioned and said system organizes the cars into groups in such a way that the respective upper car in each shaft is used to serve the upper stories, and the respective lower car is used to serve the lower stories. During the apportioning of the travel orders, it is taken into account as a peripheral condition that the two cars in each shaft must not impede one another.

There is extensive patent literature on control methods for elevator systems with two or more elevator cars per shaft and/or multiple shafts.

U.S. Pat. No. 6,955,245 B2 describes an elevator system with three shafts, in which two or more elevator cars are located. The three shafts are divided into one shaft for upward journeys, a further shaft for downward journeys and a shaft for parking elevator cars. In the case of increased travel requests, for example a third elevator car is transferred into the shaft for upward journeys or downward journeys. After the corresponding travel orders have been executed, the empty car can be transferred into the parking shaft at the next transfer station.

US 2010/0078266 A1 describes an elevator system with at least one shaft and at least two cars which can be moved independently of one another in a shaft. A described example uses two cable elevator cars. These can move in the same direction or in the opposite direction. Sensors for the load, speed and distance between the cars are present and they transmit corresponding signals to a control unit. The central control then controls the cars as a function of the sensor signals, depending on travel orders.

DE 37 32 240 C2 describes an elevator system with a plurality of elevator shafts which each serve different areas of stories. When there is a high traffic volume, the departures of the elevator cars which have stopped at a transfer floor are delayed so that a sufficient number of passengers can enter.

EP 1 440 030 B1 discloses an elevator system with at least two elevator shafts, wherein transfer levels for changing between the shafts are present, in order to serve specific areas of stories. Each shaft is divided into what are referred to as local shafts in which the elevator cars can move independently of one another.

US 2003/0098208 A1 discloses an elevator system with shafts in each of which two elevator cars can move. The requested destination positions are administered and each of the two elevator cars is assigned its own zone and a common zone of stories. The common zone can be travelled through only by an elevator car if no impedance with other cars can occur wherein after the corresponding travel order has been executed, the common zone has to be exited again.

U.S. Pat. No. 5,107,962 A relates to an elevator system with a shaft in which two or more elevator cars can move, wherein the cars are each cable elevator cars. For example, here two elevator cars are arranged, and can move, one next to the other in an upper shaft part, while a further elevator car can move in a lower shaft part.

EP 2 341 027 B1 proposes a method for controlling an elevator system with at least one shaft in which at least one elevator car for transporting persons and/or loads can be moved by means of a drive device, and with an elevator control device which controls the operation of the elevator system, wherein usage data of the elevator system is collected over a predefined collection time period and evaluated, and the operation of the elevator system is controlled predictively as a function of collected usage patterns, in a way which is optimized in terms of energy and/or transportation capacity.

EP 2 307 300 B1 discloses a method for controlling an elevator system with a plurality of elevator cars per elevator shaft on the basis of the already mentioned destination selection control. In this context, the operation of the elevator system is controlled with particular consideration for passengers with impairments, by means of what is referred to as an impairment parameter.

WO 2007/024488 A2 relates to the control of a twin elevator system as already mentioned above, with a plurality of shafts and a plurality of elevator car pairs, wherein an elevator car is respectively assigned a specific zone of the corresponding shaft.

WO 2004/048243 A1 also discloses a method for controlling a twin elevator system with a destination selection control. If a destination call relates to the common travel way along which two elevator cars can be moved separately upward and downward, the travel way section which is necessary to service the destination call is assigned to an elevator car and the other elevator cars are blocked for the time of the assignment. The control method according to WO 2004/048244 A1 is based on the same elevator system and on the same principles as those of WO 2004/048243 A1.

EP 0 769 469 B1 relates to what is referred to as a multi-mobile elevator group with a plurality of shafts and a plurality of elevator cars, wherein each car is driven by a separate independent drive and provided with a separate brake. The shafts are respectively connected at their upper and lower ends to one another by a connecting passage. In this way, the cars can change their direction of travel by changing shaft. The direction of travel of a car can also change within a shaft. In order to increase the efficiency and the safety of this elevator system it is proposed in this document that each car be equipped with a separate safety module which can trigger braking processes both in its own car and in adjacent cars, wherein the safety module calculates the necessary braking behavior of the cars from current travel data of the cars on the basis of stop enquiries, and collisions between cars are therefore prevented.

WO 2008/136692 A2 discloses a cyclical multi-car elevator system with a upward-leading shaft and a downward-leading shaft and a plurality of elevator cars which can be moved upward and downward in these two shafts. At the two ends of these shafts there are transfer stations by means of which the cars can be transferred in the horizontal direction from one shaft to the other shaft. These stations can also be configured to supply additional cars when required. Furthermore, stations which are located between the two shafts may be present for taking out of circulation a car which is, for example, defective. This cyclical multi-car elevator system can be scaled to the respective requirement. Individual details on the control method of this multi-car elevator system are not given in this document.

A cyclical multi-car elevator system in the style of a paternoster was filed by Hitachi in EP 1 647 513 A2. In this system, a plurality of elevator cars circulate in a upward-leading shaft and in a downward-leading shaft, the two ends of which shafts each constitute transfer stations with individual cars from one shaft into the other shaft. In each case two cars are coupled to one another by means of cable drives, with the result that, for example, when one of the two cars is located in the upper part of the elevator upward-leading shaft, the other of the two cars is located in the lower part of the downward-leading shaft. A plurality of such elevator car pairs are accommodated in the two shafts by means of a special steel-cable drive system. Each elevator car of such a pair of elevator cars serves as a counterweight for the respective other elevator car. Individual pairs of elevator cars can be operated independently of the other pairs, permitting mutual impairment to be ruled out.

The principle of the cyclical multi-car elevator system has the advantage of requiring little space, since in principle only two elevator shafts are required, wherein a plurality of elevator cars can be accommodated in the respective shafts, in order to achieve a largest possible transportation capacity.

DETAILED DESCRIPTION

Figure 1:
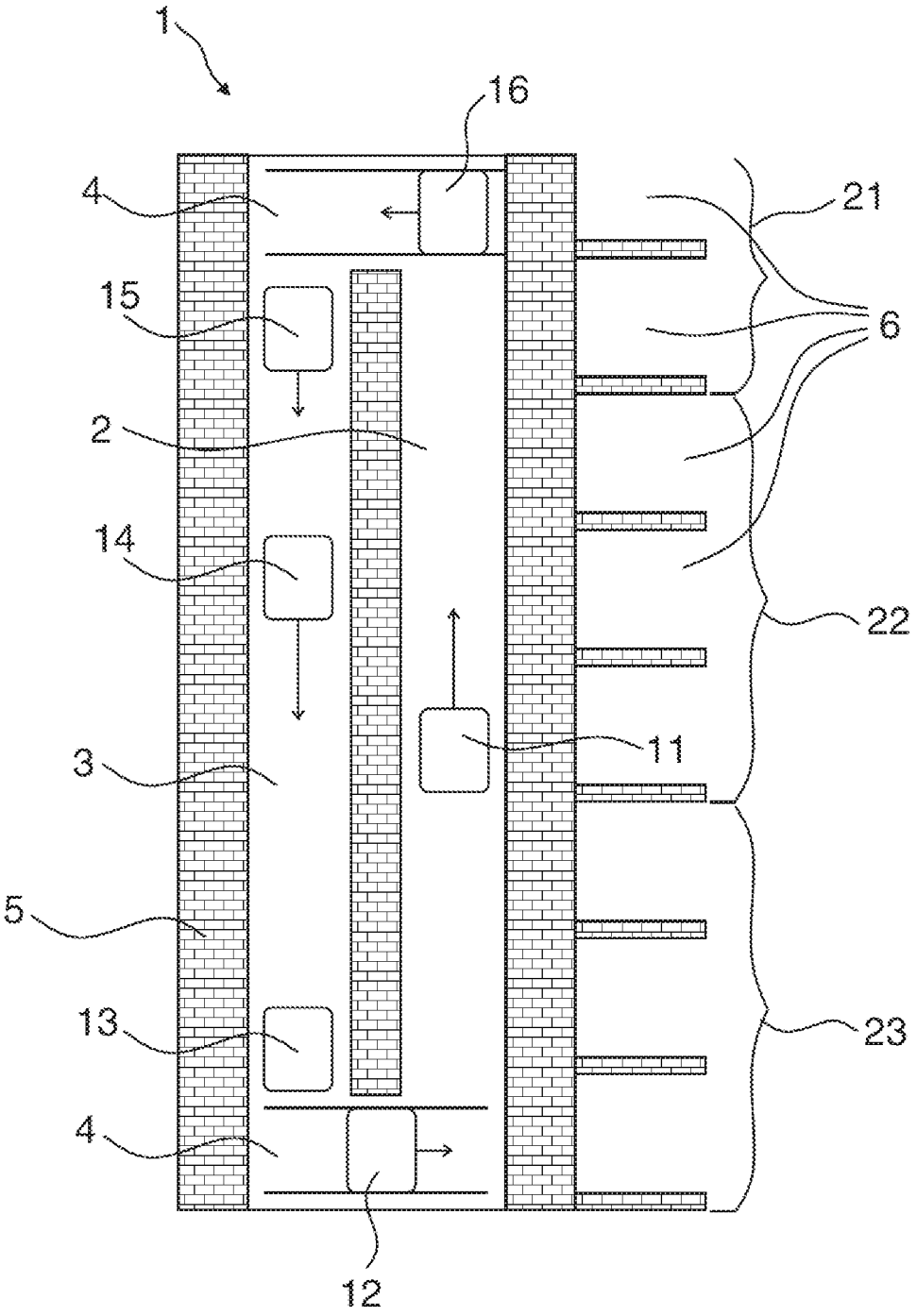
FIG. 1 is a schematic view of an example transport system configured as an elevator system.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

One example object of the present disclosure is to develop a control method for a cyclical multi car elevator system that can be applied to systems that are configured in a desired way and have a plurality of cars.

The-present disclosure concerns a method for controlling a transport system and a corresponding transport system. It should be understood that the present disclosure is not limited to elevator systems, but relates generally to transport systems and their control.

In some examples, the transport system comprises at least two conveyor sections along which at least three cars are moved individually, and essentially independently of one another.

In the case of an elevator system, the conveyor sections are, in particular, formed by vertically running shafts. Furthermore, in particular horizontally running conveyor sections are provided. However, the conveyor sections can in principle run any desired fashion, in particular at least partially on circular paths, along a diagonal etc. In the case of elevator systems, "cars" are known as elevator cars, but otherwise the "cars" constitute conveyor means for persons or objects. In the most general case, such a car can consequently also be a vehicle, a robot or the like which is used to accommodate persons or objects for transportation and/or to permit them to be set down at the end of transportation.

The invention will be explained below, with reference being made, by way of example, to the preferred special case of an elevator system, in order to make it easier to understand the essence of the invention by means of an exemplary case.

According to the invention, in the cyclical operation of the transport system each car passes through a first conveyor section (assigned to it) starting from a first start position (assigned to it) and subsequently passes through a second conveyor section (assigned to it) back to the first start position. Such cyclical operation is, in particular, a circulating operation. In the case of an elevator system, a certain car consequently passes through an upward-leading shaft starting from a first start position and subsequently passes through a downward-leading shaft back to the first start position. The corresponding elevator system consequently constitutes a form of a cyclical multi-car elevator system as has been mentioned in the introduction to the description. Where necessary, any car can stop at at least one stopping point along a conveyor section. In particular there is provision that each car stops at at least one stopping point along a conveyor section.

According to the invention, one or more successive stopping points are respectively assigned to one block, wherein the number m of cars is preferably at least equal to the number j of blocks. In this context, the travel of the cars is controlled in such a way that the cars successively approach a respective previously specified block. In particular, the travel of the cars is therefore controlled in such a way that firstly in each case a specific block of stopping points is assigned in advance to each car as a function of the traffic volume. This assignment can occur, for example, on the basis of a known traffic volume at a particular time of day or a statistically determined traffic volume. Traffic volume is to be understood here as being the volume of departure stopping points and the demand for destination stopping points. Furthermore, with respect to this assignment it is necessary to take into account the distribution of the cars among the blocks while taking into account minimum impedance of the individual cars with respect to one another. The transport to the respective destination stopping point is preferably carried out by means of a destination selection control with that car which is assigned to the block which is associated with this destination stopping point. Destination selection control is to be understood here as meaning that the respective departure and destination stopping points along the conveyor sections of the transport system for controlling the travel of the cars are known.

The passage through first conveyor section and the second conveyor section, in other words the travel of each car starting from its first start position back to this first start position, takes place in a cycle time which is the same for all the cars. This cycle time is suitably predefined as a function of the number of stopping points and the traffic volume.

In particular, the number j of blocks is at least three, and the number m of cars is greater than or equal to the number j of blocks.

The basic principles of the invention will be explained in more detail with reference to a cyclical multi-car elevator system: a group of j cars is extracted from a number m of cars, wherein for the sake of simplicity the j cars are intended to constitute directly successive cars in their journey through the elevator system. Furthermore, for the sake of simplicity it is assumed that all the cars are to pass through the same first conveyor section, that is to say an upward-leading shaft, and subsequently all the cars are to pass through the same second conveyor section, that is to say a downward-leading shaft of the elevator system.

The first car of the specified group of j cars then approaches a previously specified block, the second car approaches a block assigned to it and so on, until the last car approaches a block of stopping points assigned to it. In order to maintain the cyclical operation, it is also possible for a car to perform empty travel, that is to say a travel into a block in which no departure and/or call requests are present. According to the second measure of the invention, the same cycle time is predefined for each car for passing through the first and second conveyor section, i.e. the cycle of each elevator car for a complete travel through an upward-leading shaft and through a downward-leading shaft back to the start position is covered in the same time.

The control of the travel of the cars according to the invention is based on a periodically repeating cycle in which each car passes through a first conveyor section starting from a first start position and subsequently passes through a second conveyor section back to the first start position. This cycle can be considered to be a predictable timetable of the cars. However, in contrast to a fixed timetable the control according to the invention permits flexible deviations for each car within predetermined time limits, permitting individual servicing of stopping points according to the stopping requirements. The distribution according to the invention of the cars among the blocks of stopping points advantageously avoids mutual impediment of the cars or reduces such mutual impediment, at least compared to conventional methods. The sum of the two specified measures, specifically the same cycle time and the distribution among blocks, provides improved transport capacity while taking into account impediment of the individual cars which is to be avoided.

It is to be noted that the terms "first conveyor section", "second conveyor section" and "first start position" can be respectively assigned to a car, in other words consequently can differ for each car. In the case of an elevator system, it is possible, for example, for a first car to be moved upward in a first shaft starting from its first starting position (on the ground floor), while a second car can be moved upward in a second shaft starting from its first start position (which can again be on the ground floor). In the same way, the two cars can each be moved downward in separate shafts or at least along separate conveyor sections, in order subsequently to move back to their respective first start positions. According to the invention the cycle times for passing through the respective first and second conveyor sections are the same for each car.

Furthermore, it is also conceivable that a car changes between two shafts on the way through its conveyor section.

The first conveyor section of a car is therefore a first route which a car passes through as far as a specific point, while a second conveyor section means an adjoining path of this car, in particular an adjoining path which the car travels along to return to its first start position. The directions of the first and second conveyor sections can be random insofar as they together result in a closed path. For example, the first conveyor section and the second conveyor section can each form a semicircle, which semicircles together form a circle. For example, the first and second conveyor sections can also be arranged linearly one next to the other in respective opposite directions. The first and second conveyor sections do not have to have the same length but rather can have different lengths.

Given a number of j blocks from the number m of cars, a (first) group of j cars is advantageously defined, the travel of which is advantageously controlled as follows:

A first car approaches a first block, a following second car approaches a second block, and so on, and a following j-th car finally approaches a j-th block. In this context, the blocks are selected in such a way that the j-th block lies closer to a first home position than the (j−1)-th block, the (j−1)-th block in turn lies closer to the first home position than the (j−2)-th block, and so on. In other words, a first car therefore approaches the block which is furthest away from the first home position, a following (in particular the directly following) second car approaches a second block which lies closer to the first home position, and so on until the last car approaches the block which lies closest to the first home position. The first home position is defined by the first start positions of the cars: if all the j cars respectively have the first start position, the specified first home position in fact constitutes this first start position. If the respective first conveyor sections (or a portion thereof) of the cars lie, for example, parallel to one another (for example in the case of a plurality of upward-leading shafts), the first home position constitutes that level at which the respective first start positions of these cars lie (for example the ground floor in the case of an elevator system). The first home position can also be defined to the effect that it contains the first start positions of the cars. The first home position therefore forms the "start line" from which the cars begin their transportation along their respective first conveyor sections. In the case of an elevator system, this "start line" coincides with the "starting stage" which is usually the ground floor. In other transport systems, the first start positions may also lie one next to the other, for example, and then form such a start line as a first home position; however it is also conceivable that the first start positions are arranged opposite with respect to one another, for example in the case of a circular or curved-shape profile of the first conveyor section (comparable with the start line, in a 400 m, of race lanes arranged one next to the other which run at least partially in a curved shape in a stadium).

The basic principles of this particularly advantageous refinement of the invention will in turn be explained in more detail with reference to a cyclical multi-car elevator system: said group of j cars is extracted from a number m of cars, wherein again for the sake of simplicity the j cars are to be assumed to constitute represent directly successive cars in their journey through the elevator system. Furthermore, for the sake of simplicity it will be assumed that all the cars are to pass through the same first conveyor section (upward-leading shaft) and the same second conveyor section (downward-leading shaft), with the result that all the cars pass through the same first start position, which points is consequently identical to the first home position. The first car of the specified group of j cars then passes through the block of stopping which lies at the highest location, while the second car approaches the block of stopping points lying below said block, and so on, until the last car approaches the closest block of stopping points wherein one or more successive stopping points are respectively assigned to one block. This measure initially ensures that the elevators are distributed among various blocks without impeding one another. Where necessary, each car stops at at least one stopping point of the block assigned to it. As a result of this measure, the cars can be distributed in an optimum way among the blocks which are present, with minimum possible mutual influence, and the traffic volume can be taken into account in an optimum way. In particular there is provision that each car stops at at least one stopping point of the block assigned to this car.

According to the second measure of the invention, the same cycle time is predefined for each car for passing through the first and second conveyor section, i.e. the cycle of each elevator car for a complete journey through an upward-leading shaft and a downward-leading shaft and back to the start position is covered in the same time.

In one advantageous refinement, each block of stopping points is approached by one or more cars. Depending on requirements, that is to say according to stopping requests at specific stopping points of a block it is possible to select different numbers of cars for the respective blocks. For example, in the case of three blocks, a first car approaches the block which is furthest away, the directly following second car approaches the center block and the directly following third car approaches the closest block, wherein a following fourth car approaches the block which is furthest away, and the following three cars approach the three blocks in the same way as the first three cars if a particularly large number of stopping requests are present for the block which is furthest away.

It is to be noted that in principle it is also conceivable to permit two directly successive cars to approach a block together. This is advantageous, in particular, if these cars are equipped, for example, with a suitable sensor system which reliably avoids collisions or impediments. In this way, even relatively large numbers of stopping requests in a specific block can be dealt with.

It is particularly expedient if the number m of cars is selected as a multiple of the number j of blocks, in particular as an integral multiple of the number j of blocks where $m=k \cdot j$, $k=1, 2, 3, 4, \ldots$. The number m of cars is preferably the same as or twice or three times the number j of blocks. The number m of cars is to be selected here, in particular, as a function of the number of approachable stopping points, wherein the number m of cars is advantageously lower than number of the stopping points. Conversely, given a number m of cars it is appropriate to select a same number j of blocks or half the number of cars or a third of the number of cars as the number j of blocks. Depending on requirements, that is to say depending on stopping requests, one or more stopping points can be assigned to one block. A block can therefore contain, for example, just a single stopping point with a large number of stopping requests. Conversely, a block can contain a multiplicity of stopping points each with a relatively small number of stopping requests.

If the number of cars is at least an integral multiple where $k>1$ of the number j of blocks, it is appropriate if each further group of j cars which follows the specified first group approaches the j blocks in the same way as the first group of j cars. Given three blocks and six cars, for example a first group of three cars successively approaches the three blocks in the indicated fashion, after which the second group of three cars approaches the three blocks in the same way. Therefore, for example the first and fourth cars respectively firstly approach the block which lies furthest away, the second and fifth cars respectively approach the center block, and the third and sixth cars respectively approach the closest block.

Furthermore, it is appropriate if the j blocks are divided into directly successive blocks. In other words, all the existing stopping points are assigned to blocks, with the result that the blocks lie directly one next to the other.

According to one advantageous further embodiment variant of the invention there is provision for the cars of one group of j cars to be selected as directly successive cars. However, the fact that this does not necessarily have to be the same has already been explained above using examples.

Until now, a transport system has been considered in which each car stops when necessary at at least one stopping point at least along one conveyor section. For example, stopping points can therefore be provided for the respective cars only along the (respective) first conveyor section, while the (respective) second conveyor section is passed through back to the (respective) first start position, for example without the cars stopping. In the case of an elevator system as a transport system, it is, on the other hand, advantageous to identify a first conveyor section of a car with a first car path, in particular an upward-leading car path which is predefined by a first elevator shaft, and the second conveyor section of a car with a second car path, in particular a downward-leading car path which is predefined by a second elevator shaft. In such a transport system, the stopping points along the first conveyor section and the stopping points along the second conveyor section are each respectively divided into blocks. In particular, it is provided as a further advantageous embodiment variant of the invention to use different blocks for the two conveyor sections. This is the case, in particular, if specific stopping points, that is to say stories, for upward journeys are temporarily subjected to different stopping requests than for downward journeys.

With this type of transport system it is advantageous to assign a second home position for the cars to the second conveyor section, wherein this second home position is defined, analogously to the first home position, by second start positions of the cars. If the second start position is the same for all the cars, in particular if the second start position is the highest story which can be approached by the cars, the second home position corresponds to this second start position. If all or some of the second start positions lie one next to the other (for example stopping points which lie one next to the other in the highest story), the connecting line of these second start positions defines the second home position. In turn, if the cars successively approach a respective previously specified block of the second conveyor section, wherein it is again particularly advantageous if the travel of a (first) group of j cars to the blocks of the second conveyor section is controlled with respect to the second home position in the same way as the travel of these cars to the blocks of the first conveyor section with respect to the first home position.

This principle will be in turn be clarified using the example of an elevator system: for example, the ground floor is predefined as the first home position, while, for example, the highest story is predefined as the second home position. For the sake of simplicity, the first conveyor sections which are assigned to the respective cars will each be assumed to be the same as the same first start positions and form an upward-leading shaft, while the second conveyor sections which are assigned to the cars form, with the same second start positions, the downward-leading shaft. In this cyclical multi-car elevator system, the first car then approaches the top block of stopping points, in order to serve stopping requests at the stopping points of this block. The second car approaches, for example, the next block lying below, and so on, until the last car of the first group of j cars approaches the block which is closest to the first start position. By means of a suitable transfer device, each car can be transferred into the downward-leading shaft. Starting from the top story as a start position which is common to all the cars, the travel of the cars in the downward direction takes place in the same way as the travel of the cars in the upward direction. Furthermore, the first car approaches the block which is furthest away from the second start position and serves in said block the corresponding stopping requests at the corresponding stopping points of this block. The second car approaches in a corresponding way the next highest block, and so on, until the last car of this group of j cars approaches the block at the highest location, that is to say that block which lies closest to the second start position. Subsequently, every car is transferred, by means of a further transfer device, into the upward-leading shaft and back to the first start position, as a result of which a cycle has been passed through.

This type of control of a cyclical multi-car elevator system, together with the further specification that the cycle time is the same for each car, has proven optimum with respect to the transportation capacity and at the same time the requirement for the minimum mutual influence or impediment of the individual cars.

In general, and in particular in the case of elevator cars, blocks can be defined globally for the first and second conveyor section. This is the case, in particular, if a stopping point of the first conveyor section and a stopping point of a second conveyor section are in the same story, as is the case with the elevator systems under consideration here. For example, the first story forms, starting from the ground floor below it, the first stopping point in the upward-leading shaft (first conveyor section), as well as the penultimate stopping point in the downward-leading shaft (second conveyor section). The first story can therefore be assigned to a first block in the first conveyor section and to a last block in the second conveyor section, wherein both blocks physically comprise the same stories.

As already stated above, the first conveyor section of one car can differ from the first conveyor section of another car. The same applies to the second conveyor section. In the case of the cyclical multi-car elevator system under consideration here, for example two shafts or conveyor sections can be provided for upward travel, and one shaft or conveyor section for downward travel. It is also possible to change this apportionment depending on the time of day, that is to say for example the specified apportionment can be implemented only in the morning, while in the afternoon two conveyor sections lead downward and one conveyor section leads upward. Consequently, the respective first conveyor sections of the upward-leading cars differ depending on which cars are assigned, for example, to the upward-leading shafts. In individual cases it may also be appropriate to permit cars to change shaft.

It is expedient if each car stops in each case at at least one predetermined stopping point per cycle, said stopping point being referred to below as the "critical stopping point". In particular that stopping point with the on average longest stopping time is selected as a critical stopping point. The ground floor typically constitutes such a critical stopping point in an elevator system. This particular stopping point preferably also forms the first start position of each car. The ground floor then correspondingly forms the first home position. If the lobby or the event area in a hotel is located in another story, it is appropriate to define the respective story as a further critical stopping point. Such stories then constitute, for example, stopping points with the second longest or third longest stopping time of the cars. Critical stopping points therefore form bottlenecks for the traffic volume. In order to relieve these bottlenecks it is advantageous to define that all the cars continuously stop at the critical stopping point or at the critical stopping points during their circulation, in order to be able to effectively serve the corresponding stopping requests.

In the control method according to the invention as explained here, cars approach specific blocks of stopping points which are assigned to them, in order to serve stopping requests there. In addition, it is, however, also possible for a car to approach a stopping point where necessary, that is to say when there is a corresponding stopping request, outside the block which is assigned to it. Such a stop will be referred to below as an "intermediate stop". In this context it is expedient if a car, when necessary, makes an intermediate stop at a stopping point after the first start position on the way to the block which is to be approached. In particular there is provision that the car makes at least one such intermediate stop on the way to the block which is to be approached. If a second start position is defined on the second conveyor section, it is expedient, where necessary, to make an intermediate stop at a stopping point on the way from the approached block back to the first start position after leaving the second start position. In particular there is provision that the car makes at least one such intermediate stop after leaving the second start position. The expediency of this embodiment is understandable, in particular, in the case of an elevator system: a car which travels upward in a shaft to the block assigned to said car can, given a corresponding stopping request, make an intermediate stop in order to pick up a passenger and to convey said passenger to the corresponding block. Conversely, a car in the downward-leading shaft can, after reaching the block assigned to it, pick up passengers from the corresponding stopping points and make intermediate stops on its further path from the approached block, in order, in the case of corresponding stopping requests, to transport passengers to the corresponding stopping points, in particular to the ground floor.

Generally, intermediate stops can constitute stopping points which a car approaches outside the block assigned to it in a corresponding stopping request. Since the cycle time for all the cars is the same, intermediate stops can be made only if this does not cause the cycle time to be exceeded. In a system with destination selection control, the expected cycle time per car can be calculated in advance and updated during the travel. Therefore, the elevator control can determine which cars have time for intermediate stops and which do not. This is advantageous since the stopping times at intermediate stops can be selected in a variable fashion such that the predefined cycle time is complied with. Stopping time is understood in this context also to comprise a time of zero seconds, with the result in this case that no intermediate stop can be made. In principle it is also possible for a car to make an intermediate stop at a stopping point which is selected by the control system, for example because the actual travel time greatly undershoots the predefined cycle time, with the result that the respective car has to make a "pause". In the case of elevator systems this is appropriate, in particular, in the case of cars without passengers.

Furthermore, the stopping times at the abovementioned predetermined critical stopping points can advantageously be selected in a variable fashion in order to comply with the predefined cycle time. Essentially what was stated above with respect to the stopping times at intermediate stops applies here.

A maximum stopping time per stopping point can be predefined as a function of the cycle time. This measure is appropriate, in particular, in the case of events which are difficult to predict, for example relatively long loading and unloading processes or malicious tampering with a car, for example the prevention of the continued travel of a car by holding the car doors open. In such a case, the control of the transport system can "drop out" as a safety measure, that is to say when the maximum stopping time is exceeded the control can prolong the predefined cycle time by the period until the corresponding car is ready to move again. Since the prolongation of the cycle time affects all the other cars in the same way, the respective actual circulation time thereof must also be correspondingly prolonged. For this purpose, in particular the stopping times at critical stopping points and/or at intermediate stops or even at the respectively currently approached stopping point can be correspondingly adapted again.

If a plurality of critical stopping points are defined, the control of the transport system can advantageously be adapted in such a way that not only the total cycle time but also partial times of the cycle which are required by a car for the distance between two successive critical stopping points are always the same for all the cars. In an elevator system, it may be appropriate, for example, to keep the partial times for the upward travel and downward travel in addition to the total cycle time the same for all the cars. For this purpose, the first and second start positions of the cars are defined as critical stopping points.

In the control method according to the invention there are the following main variables which can be changed as a function of the respective demand and/or depending on the time of day. These are the assignment of stopping points to a block, the number m of cars in the transport system, the cycle time for the cars, the number of cars per block and the number and position of critical stopping points. Such a "dynamized" control of the transport system is expedient in particular if fluctuating demand has to be coped with. In the case of an elevator system with destination selection control, for example a matrix with start points and destination stopping points can be produced from the corresponding stopping requests at various times of day. The corresponding demand can be evaluated statistically, according to which one or more of the specified main variables is defined to cover the demand in an optimum way. In particular, the number of stories per block and the cycle time can be changed at short notice.

The invention also relates to a corresponding transport system with a control device for controlling the travel of cars according to the inventive control method described.

A transport system according to the invention has at least two conveyor sections and at least three individually movable cars, wherein in the cyclical operation each car passes through a first conveyor section starting from a first start position and subsequently passes through a second conveyor section back to the first start position, wherein at least one stopping point is provided at least along a conveyor section, and wherein a control device is present which is designed to control the travel of cars in accordance with the control method described in detail above. The control device is operably connected to the respective drives of the cars. In order to avoid repetitions, reference is therefore made here to what has been stated above which applies to the transport system according to the invention in an analogous fashion.

It may be expedient, in particular in the case of conveyor sections which are arranged linearly one next to the other, if a transfer device for transferring cars into the respective other conveyor section is present along, in particular at the end of, at least one conveyor section. In a cyclical multi-car elevator system, a transfer device for transferring cars from the upward-leading shaft into the downward-leading shaft or from the downward-leading shaft into the upward-leading shaft is located, for example, at each of the upper and lower ends of the shaft.

The transfer system according to the invention constitutes, in particular, an elevator system, and, in particular, a cyclical multi-car elevator system. The specified two conveyor sections constitute here, for example, two shafts in which at least three individually movable elevator cars can be moved as cars. It is also possible to use three or more shafts, wherein at least one shaft always leads upward and one shaft always leads downward. The cars can then be distributed among different shafts, with the result that overall more cars can be used in order to cover a higher demand. In the sense of this application "shaft" does not necessarily mean a separate shaft in a building, but also means an upward-leading or downward-leading linear travelway. For example two or more elevator cars can be moved one next to the other downward or upward in a shaft in a building. Consequently, a first conveyor section through which a car passes can constitute an upward-leading "shaft" and a second conveyor section which is to be passed through by a car can constitute a downward-leading "shaft".

It is advantageous and expedient to position the first start positions on the ground floor of the elevator system. The ground floor then also forms the above-mentioned first home position. Ground floor generally means here that story through which a building is usually entered in order to arrive at other stories of the building from there. Of course, there may also be different levels via which a building can be entered. In such a case it is favorable to define that level with the highest traffic volume as the first home position, and to position possibly critical stopping points at further levels.

It is advantageous and expedient to position the second start positions in the top story of an elevator system. In this respect, reference is made to what has already been stated. Furthermore, it is possible and expedient to assign a plurality of first shafts and/or a plurality of second shafts to one block in the sense of the definition of shaft as given above. For example, an elevator system can have two upward-leading shafts and one downward-leading shaft. The elevator cars are distributed suitably over the two upward-leading first shafts (conveyor sections). All the cars move downward again via the downward-leading second shaft (conveyor section). The block which is furthest away from the first home position (ground floor) comprises, for example, the top five stories as stopping points. This block is approached, for example, by a first car which can be moved in one of the two upward-leading shafts. The following block is approached by a second car which can be moved, for example, in the other of the two upward-leading shafts.

Further advantages and embodiments of the invention can be found in the description and the appended drawing.

Of course, the features which are mentioned above and the features which are still to be explained below can be used not only in the respectively specified combination but also in other combinations or alone without departing from the scope of the present invention.

FIG. 1 is a schematic view of an elevator system 1 as a transport system with two conveyor sections which are embodied as shafts 2, 3 and a total of six individually movable elevator cars, that is to say elevator cars which can be moved separately and therefore largely independently of one another. The elevator cars are here cars of the transport system. Therefore, a first conveyor section forms a first upward-leading shaft 2 and a second conveyor section forms a downward-leading second shaft 3. Each conveyor section has at its end a transfer device 4 which is configured in a manner known per se to transfer a car from the first shaft 2 into the second shaft 3 or from the second shaft 3 into the first shaft 2. In the exemplary embodiment shown, the transfer devices 4 are located in the bottom or top story of the building 5. The shafts 2 and 3 are embodied in this exemplary embodiment as building shafts. However, it is also possible to use a single building shaft in which the cars can be moved upward or downward along conveyor sections which run in parallel.

In the elevator system 1 illustrated here, each car can be moved independently of any other car by means of linear drives. An implementation of the illustrated cyclical multi-car elevator system as a cable elevator is in principle conceivable but is structurally costly and complex.

In the cyclical multi-car elevator system 1 illustrated in FIG. 1, m cars can move similarly to a paternoster in a circulation operation, wherein the cars are denoted by the reference numbers 11 to 16 (m=6). In general, there are p shafts between which upward and downward transfer can take place. In the illustrated case, p is equal to 2. In contrast to the paternoster principle, each car is driven independently of the other cars and can therefore stop at any desired stopping point independently of the other cars. The stories are denoted by 6. If the elevator system serves n stories, it has a total of $q=n\times p$ stopping points. In the illustrated exemplary embodiment, n equals 8, so that q=16.

For the exemplary embodiment illustrated in FIG. 1, the control of the elevator system 1 is defined by means of the schematically illustrated control device 7, which is operatively connected to the drives of the cars 11 to 16, in a plurality of steps:

a) Division into Blocks:

Firstly, all the n stories 6 of the associated building 5 are divided into j logical blocks, where $j\leq n$. The blocks can each comprise an equal or similar number of stories or else an intentionally different number of stories, in order to take into account the different demand at different stories. In the present case, j equals 3 and the three blocks are denoted by 21, 22 and 23. The blocks 22 and 23 each comprise three stories, while the top block 21 comprises merely two stories. Each block can be assigned an equal number or a different number of cars which serve the respective block. The number of cars assigned to a block shall be k. In FIG. 1, j equals 3, and k=2 can be selected for each block. However, different numbers k can also be selected for each block. With a further explanation, k=2 and $m=k\times j=6$.

b) Determination of the First Start Position:

For the building 5 under consideration, the stopping point with the longest average stopping duration is determined, since this constitutes the bottleneck for the traffic volume. This is referred to as the critical stopping point. A critical stopping point can be located, typically, in a ground floor lobby in which a very large number of passengers enter or leave an elevator, resulting in correspondingly long stationary times for the cars. In the exemplary embodiment according to FIG. 1, the ground floor forms the first start position which is common to all the cars, and therefore the first home position in the upward-leading first shaft 2. Depending on the configuration of the building, it is also possible for a different stopping point to constitute this first start position. It will now be specified that all the cars 11 to 16 always stop at this first start position on their circulation, in order to permit passengers to change over. This first start position therefore defines the starting point for the cycles of the cars and defines a critical stopping point.

c) Partial Cycle in the First Shaft:

For the sake of simpler explanation, it will be assumed below that the critical stopping point is the entry for the passengers on the ground floor of the building, which will actually usually be the case, for example during the morning upward traffic. Starting from this stop, that is to say from the first start position, the m=6 cars 11 to 16 then successively approach their respective block and in doing so transport their passengers to said block. In this context, it is decisive for efficient operation that the cars serve the j=3 blocks 21 to 23 in the suitable sequence. In this context, car 11, which serves the top block 21, moves away first, followed by the car 12 for the block 22 which is second from the top, in turn followed by the car 13 for the lowest block 23. The next group of three cars 14 to 16 is assigned to the blocks 21 to 23 in the same way as the first three cars 11 to 13, with the result that the car 14 approaches the block 21, the car 15 approaches the block 22, and the car 16 approaches the block 23. If appropriate, the cars make intermediate stops on the way to the respectively assigned block, in order to pick up the further passengers who come from other stories and would like to travel to the block assigned to the respective car. A corresponding assignment of an elevator car is possible on the basis of the destination selection control which is present. After a car has served the block assigned to it, it travels essentially empty to the transfer point at the top story. There, it uses the transfer device 4 to change into the downward-leading shaft 3. In FIG. 1 this case is illustrated for the elevator car 16. The required time up to this point shall be referred to as T1, and is obtained as a total of the time losses for the main stop at the first start position, for the intermediate stops for picking up further passengers, for the exit stops and, if appropriate entry stops in the assigned block and for the travel times for the total upward travel and for the transfer process.

d) Partial Cycle in the Second Shaft:

After the transfer of a car into the downward-leading shaft 3, the pattern continues correspondingly in the inverse direction. The first car, which has served the top block in an upward direction, that is to say the cars 11 and 14 in the example in FIG. 1, serves the last block again in the downward travel, now the block 23. This last block lies furthest away from a second home position, here at a distance from the second start position which constitutes the stopping point in the top story in the downward-leading shaft 3. For example, the car 14 mainly collects passengers in the block 23, to be more precise at the stopping points of the block 23 when corresponding requests occur. Subsequently, that car which has served the block 22 serves the penultimate block, here again the block 22. Subsequently, the car which has served the block 23, that is to say the cars 13 and 16, in turn serves the block 21 which is closest to the second start position. After its block has been served, the cars travel downward again and travel back to the first start position which forms a critical stopping point at which each of the cars stop. On the way to said position, intermediate stops can be made, in particular in order to let out or pick up passengers. In the illustrated exemplary embodiment, the letting out of the passengers occurs expediently at the lowest stopping point of the downward-leading second shaft 3 before the corresponding car is transferred back to the first start position by means of the transfer device 4. The time required for the downward travel together with stopping and transfer shall be referred to T2.

e) Time Condition for the Specification of Stopping Times:

After upward travel and downward travel, each car is located again at the location at the critical stopping point, that is to say at the first start position. For this circulation, each car has required the cycle time T=T1+T2. While the times T1 and T2 required for the partial cycles for each car may be different, it is decisive for efficient operation with a high transportation capacity that the entire cycle time T is the same for all the cars. The loss of time, in particular for three intermediate stops, is therefore preferably dimensioned such that in total the cycle time T is not exceeded, or is utilized as far as possible completely, over the entire circulation. If a car were to pass through the cycle too quickly, an additional waiting time could be introduced at a suitable point, for example in the lobby or at some other critical stopping point. Furthermore, in such a case the "empty travel" of the car after serving the primary block can also be used for special travel, special destinations or for further intermediate story traffic, in order to utilize the still remaining time window within the cycle time.

f) Time Offset Between the Cars:

For a total circulation, each car requires the same cycle time. Each circulation is carried out with a time offset with respect to a circulation of another car. This ensures that no car is impeded by the car travelling ahead. The time offset from one car to the next is in each case on average T/m and must be selected to be long enough to make available sufficient flexibility for intermediate stops during the travel.

Figure 2:
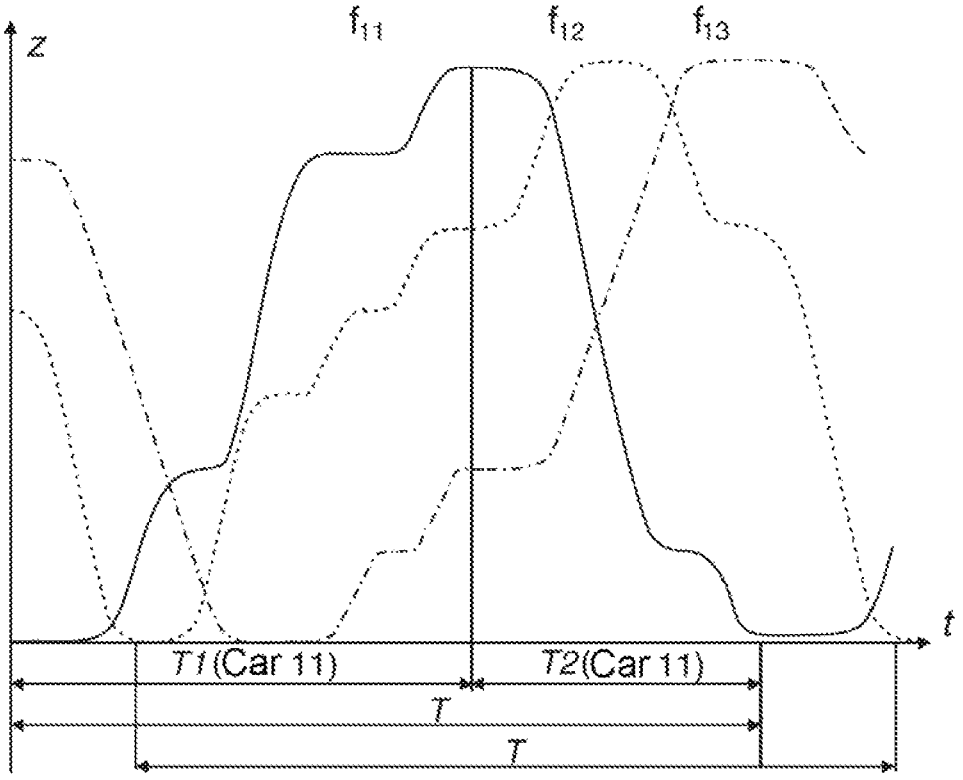
FIG. 2 is a schematic view of an example travel diagram for three cars of the example elevator system of FIG. 1 according to an example control method.

Overall, the exemplary embodiment according to FIG. 1 which is dealt with here is represented by a travel diagram, of which FIG. 2 illustrates a detail. The travel diagram illustrates the position z of all the cars plotted against the time t. The vertical direction in which the stories 6 of the building 5 in FIG. 1 are arranged is denoted by z. The travel diagram f for the car 11 is denoted by $f_{11}$, that of the car 12 by $f_{12}$, and that of the car 13 by $f_{13}$. From the travel diagram $f_{11}$ it is clear, for example, that the car 11 makes an intermediate stop on the way to the top block 21. Subsequently, a stopping point in the top block 21 is served. After the transfer into the downward-leading shaft, the car 11 approaches the lowest block 23, in order to serve a stopping point there and subsequently to return to the first start position. The travel diagram $f_{12}$ shows that the second car 12 approaches three stopping points of the center block 22 assigned to it, and subsequently changes shaft in order, in turn, to approach a stopping point in the center block and subsequently to return to the first start position. The travel diagram $f_{13}$ for the following third car 13 shows that this car approaches two stopping points of the lowest block 23, in order then to move to the transfer device 4 in the top story.

From FIG. 2 it is apparent that the cycle times T for each of the cars 11, 12 and 13 are the same.

If there are a plurality of critical parallel stopping points, for example if the transfer devices 4 constitute the critical stopping points, the control method can be adapted in such a way that not only the total cycle time T but also partial times of the partial cycles between two critical stopping points are always the same for all the cars, for example T1 and T2 in the case under consideration here.

In the text which follows, further embodiments and the advantages of the invention described here will be specified.

Each block can be assigned one or more cars which primarily serve this block. The number of cars can be defined individually for each block.

The time requirement which is provided for a main stop, for example in a lobby, and for intermediate stops at any of the stories can be varied, for example depending on the time of day, in order to be able to cope with different traffic situations in an optimum way, for example a long stop in a lobby during morning upward traffic and a short stop in the lobby linked to more time for intermediate stops at off-peak traffic times.

The control method can easily be parameterized for a given number of m cars and n stories as well as a predicted traffic demand.

This parameterization can also be carried out in an automated fashion, for example depending on the time of day, or according to measured traffic volume. The easy parameterization also permits the number of cars m to be changed, for example by removing or adding cars during operation.

The predefined cycle ensures that the available shaft space is always used efficiently by the cars. Furthermore, it is ensured that the cars are distributed approximately uniformly over the shaft space, resulting in uniform utilization of the transfer devices. These devices can therefore be configured for lower transfer speeds than in the case of travel of cars at a random distance from one another.

The predefined cycle results in an overall more predictable and more uniform traffic of the cars without traffic stoppages owing to mutual impediment. The specified advantages result in a particularly high transportation capacity of the system. The transportation capacity is even close to the theoretical optimum of the system, including a small permitted reserve for the advance planning of the stopping times.

The disclosed example control methods can advantageously be applied to any logistical tasks with a plurality of individually driven or individually movable transport devices in a circulation operation. Such logistical tasks occur, for example, in fabrication devices, or in production systems of, for example, chemical facilities.

LIST OF REFERENCE SYMBOLS

1 Transport system, elevator system
2 First conveyor section, first shaft
3 Second conveyor section, second shaft
4 Transfer device
5 Building
6 Story
7 Control device
11 to 16 Car
21 to 23 Block
T Cycle time
f Travel diagram
T1, T2 Partial cycle times

What is claimed is:

1. A method for controlling a transport system, the method comprising moving at least three cars individually in succession in a cyclical operation, wherein each of the at least three cars passes through a first conveyor section starting from a first start position and subsequently passes through a second conveyor section and back to the first start position, wherein blocks into which the first and second conveyor sections are divided each include a stopping point, the method further comprising controlling travel of the at least three cars such that the at least three cars approach a respective previously-specified block of the blocks, wherein each of the at least three cars passes through the first and second conveyor sections in an equal cycle time that has been predefined.

2. The method of claim 1 wherein a number of the blocks=j, wherein travel of a first group of j cars of the at least three cars is controlled such that a first car of the at least three cars approaches a first block of the blocks, which is the previously-specified block for the first car, a following second car of the at least three cars approaches a second block of the blocks, which is the previously-specified block for the second car, and a j-th car of the at least three cars approaches a j-th block of the blocks, which is the previously-specified block for the j-th car, wherein the j-th block is closer to a first home position defined by the first start position than the second block, wherein the second block is closer to the first home position than the first block.

3. The method of claim 2 wherein each successive group of j cars that follows the first group approaches the blocks in a same way as the first group of j cars.

4. The method of claim 2 wherein the blocks are divided into directly successive blocks.

5. The method of claim 2 wherein cars of the first group of j cars are selected as directly successive cars.

6. The method of claim 2 wherein the previously-specified block of the blocks is within the first conveyor section, wherein the at least three cars respectively also approach a previously-specified block of the blocks in the second conveyor section, wherein in both the first and second conveyor sections each of the at least three cars stops at at least one of the stopping points within the respective previously-specified blocks in the first and second conveyor sections, wherein the second conveyor section is assigned a second start position, with the second start position defining a second home position, the method further comprising controlling travel of the first group of j cars to the blocks of the second conveyor section in a same way with respect to the second home position as the travel of the first group of j cars to the blocks of the first conveyor section with respect to the first home position.

7. The method of claim 6 wherein after the second start position one of the at least three cars makes an intermediate stop at a at least one of the stopping points after leaving the previously-specified block of the one of the at least three cars.

8. The method of claim 1 wherein the previously-specified block of the blocks is within the first conveyor section, wherein the at least three cars respectively also approach a previously-specified block of the blocks in the second conveyor section, wherein in both the first and second conveyor sections each of the at least three cars stops at at least one of the stopping points within the respective previously-specified blocks in the first and second conveyor sections.

9. The method of claim 1 wherein each of the at least three cars stops at at least one predetermined stopping point per cycle.

10. The method of claim 9 wherein the at least one predetermined stopping point has a longest average stopping time of the stopping points.

11. The method of claim 9 wherein one of the at least one predetermined stopping points for the at least three cars is the first start position of one of the at least three cars.

12. The method of claim 9 wherein a stopping time at the at least one predetermined stopping point for each of the at least three cars is selected so that the at least three cars comply with the equal cycle time.

13. The method of claim 1 wherein each of the at least three cars stops at a plurality of predetermined stopping points per cycle, wherein travel times of each of the at least three cars between two successive of the plurality of predetermined stopping points are equal.

14. The method of claim 1 wherein one of the at least three cars makes an intermediate stop after leaving its first start position and before reaching its previously-specified block.

15. The method of claim 14 wherein a stopping time at the intermediate stop is selected so that the one of the at least three cars complies with the equal cycle time.

16. The method of claim 1 wherein a maximum stopping time per stopping point is predefined as a function of the equal cycle time.

17. The method of claim 1 comprising changing as a function of demand and/or time of day at least one of:

an assignment of the stopping points of the blocks;

a number m of the at least three cars in the transport system;

the equal cycle time for the at least three cars;

a number of the at least three cars per block; or quantity and positions of predetermined stopping points of the stopping points.

18. A transport system comprising:

a first conveyor section;

a second conveyor section;

at least three cars that are movable individually in succession in a cyclical operation, wherein during the cyclical operation each of the at least three cars passes through the first conveyor section starting from a first start position and subsequently passes through the second conveyor section and back to the first start position;

wherein blocks into which the first and second conveyor sections are divided each include a stopping point; and a control device configured to control travel of the at least three cars such that the at least three cars respectively approach a previously-specified block of the blocks, wherein each of the at least three cars passes through the first and second conveyor sections in an equal cycle time that has been predefined.

19. The transport system of claim 18 wherein the transport system is configured as an elevator, wherein the first and second conveyor sections include at least two shafts, wherein the at least three cars are configured as elevator cars that are disposed in the at least two shafts and are individually movable, wherein the first conveyor section comprises an upward-leading shaft of the at least two shafts and the second conveyor section comprises a downward-leading shaft of the at least two shafts.

* * * * *